US009512640B2

(12) United States Patent
Kyllonen et al.

(10) Patent No.: US 9,512,640 B2
(45) Date of Patent: Dec. 6, 2016

(54) PADLOCK PROTECTOR

(71) Applicant: ABLOY OY, Joensuu (FI)

(72) Inventors: Veli-Pekka Kyllonen, Kontioniemi (FI); Veikko Viitanen, Joensuu (FI); Toni Hedman, Kontiolahti (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 14/891,955

(22) PCT Filed: Jun. 18, 2014

(86) PCT No.: PCT/FI2014/050484

§ 371 (c)(1),
(2) Date: Nov. 17, 2015

(87) PCT Pub. No.: WO2014/207302

PCT Pub. Date: Dec. 31, 2014

(65) Prior Publication Data

US 2016/0123036 A1 May 5, 2016

(30) Foreign Application Priority Data

Jun. 28, 2013 (FI) ..... 20135715

(51) Int. Cl.
*E05B 67/38* (2006.01)
*E05B 17/00* (2006.01)

(52) U.S. Cl.
CPC ..... *E05B 17/002* (2013.01); *E05B 67/38* (2013.01); *Y10T 70/496* (2015.04); *Y10T 70/498* (2015.04)

(58) Field of Classification Search
CPC ..... E05B 17/002; E05B 67/38; E05B 67/383; E05B 2067/386; Y10T 70/485; Y10T 70/487; Y10T 70/489; Y10T 70/491; Y10T 70/493; Y10T 70/496; Y10T 70/498
USPC ..... 70/50–56, 417, 423, 424, 455, DIG. 43,70/DIG. 56; D8/333–335, 345–348
See application file for complete search history.

(56) References Cited

U.S. PATENT DOCUMENTS

| | | | | |
|---|---|---|---|---|
| 53,096 A * | 3/1866 | Ascherfeld | E05B 39/02 70/50 |
| 1,380,719 A * | 6/1921 | Johnson | E05B 67/003 70/260 |
| 1,662,612 A * | 3/1928 | Junkunc | E05B 67/38 273/120 R |
| 3,453,846 A * | 7/1969 | Foote | E05B 67/38 70/54 |
| 3,721,112 A * | 3/1973 | Wellekens | E05B 67/24 70/101 |
| 3,835,675 A | 9/1974 | Lippisch | |

(Continued)

FOREIGN PATENT DOCUMENTS

| | | |
|---|---|---|
| DE | 20 2007 011 135 U1 | 11/2007 |
| WO | WO 87/07669 | 12/1987 |

(Continued)

*Primary Examiner* — Lloyd Gall
(74) *Attorney, Agent, or Firm* — Muncy, Geissler, Olds & Lowe, P.C.

(57) ABSTRACT

The invention relates to a padlock protector including a shackle protector. The shackle protector is composed from two parts. The parts are to be placed to the opposite sides of the shackle, and they are formed into the shape of the loop and surface of the shackle. The side edges of the parts are jigsaw puzzle edges in their shape.

15 Claims, 2 Drawing Sheets

(56) References Cited

Figure 1:
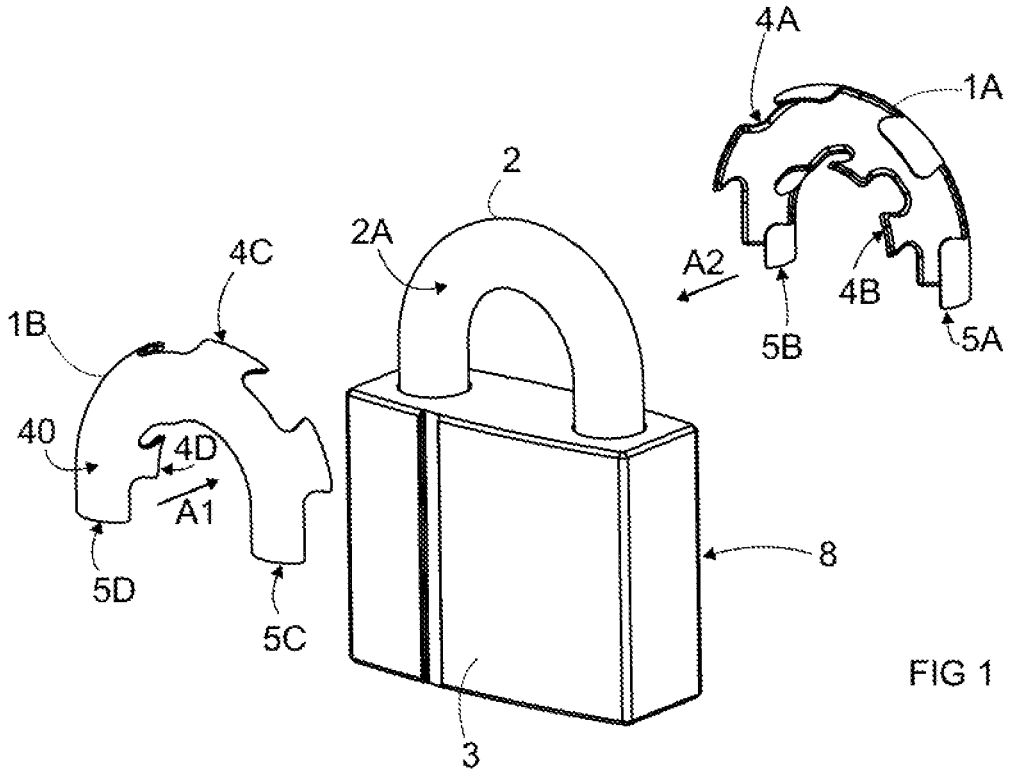

U.S. PATENT DOCUMENTS 3,916,654 A * 11/1975 Mudge, Jr. ..... E05B 67/38 292/281
4,226,100 A 10/1980 Hampton et al.
4,548,058 A * 10/1985 Bahry ..... E05B 67/38 70/417
4,763,496 A * 8/1988 Evans ..... E05B 67/24 70/368
5,046,339 A * 9/1991 Krell ..... E05B 67/02 206/523
5,146,771 A * 9/1992 Loughlin ..... E05B 67/38 70/417
5,216,903 A * 6/1993 Chen ..... E05B 67/38 70/417
5,275,028 A * 1/1994 Giarrante ..... E05B 17/002 70/455
D369,090 S * 4/1996 Santos ..... D8/346
5,845,520 A * 12/1998 Dolev ..... E05B 67/32 70/2
5,931,030 A * 8/1999 Chen ..... E05B 9/084 70/371
6,467,316 B1 10/2002 Chen
6,684,668 B1 * 2/2004 Hsueh Lee ..... E05B 67/02 70/312
6,705,134 B2 * 3/2004 Miranda ..... E05B 67/02 70/417
7,380,425 B2 * 6/2008 Elliott ..... E05B 67/02 70/38 R
7,581,423 B2 * 9/2009 Brojanac ..... E05B 17/002 70/423
8,020,414 B2 * 9/2011 Pitisethakarn ..... E05B 67/383 292/218
8,800,329 B1 * 8/2014 Dolev ..... E05B 67/36 70/290
8,820,125 B1 * 9/2014 Dolev ..... E05B 67/02 70/38 A
D732,371 S * 6/2015 Schneider ..... D8/334
2005/0183475 A1 * 8/2005 Liu ..... E05B 67/003 70/49
2005/0235709 A1 10/2005 Meckbach
2006/0162402 A1 * 7/2006 Elliot ..... E05B 67/02 70/56
2007/0234764 A1 * 10/2007 Weinberger ..... E05B 67/36 70/2

FOREIGN PATENT DOCUMENTS

WO WO 99/00567 1/1999
WO WO 2005/099349 10/2005

* cited by examiner

PADLOCK PROTECTOR

TECHNICAL FIELD

The invention relates to a padlock protector.

PRIOR ART

It is known that a padlock and also its shackle can be protected with a separate case and shackle protector. WO 8707669 discloses a known padlock protector. U.S. Pat. No. 4,226,100 discloses another known padlock protector. The purpose of these protectors is to protect the padlock from water. Additionally, the protectors dampen the noise, which can be created if the padlock rattles against the object to be locked, such as a door. In both publications, the shackle can be protected with a rubber hose, which is threaded around the shackle.

Therefore, known solutions efficiently protect the padlock from water and other outside factors, such as dust. Padlock protectors are, however, difficult to place onto the padlock.

BRIEF DESCRIPTION OF THE INVENTION

The object of the invention is to obviate the disadvantages of known art. The object is achieved in the manner described in the dependant claim. The independent claims describe various embodiments of the invention.

The invention is based on the idea that the padlock itself withstands outside conditions quite well, wherein a padlock protector does not need to be, for example, water-proof. The protector can be formed for the purpose of a partial protection. A padlock protector according to the invention protects the shackle of the padlock such that it is not free to come into direct contact with its corresponding parts to be locked. In this way, corrosion of the shackle is very effectively prevented.

A padlock protector according to the invention comprises a shackle, protector which is composed from two parts. The parts are to be placed to the opposite sides of the shackle, and they are formed into the shape of the loop and surface of the shackle. The side edges of the parts are formed like the edges of a jigsaw puzzle. The jigsaw puzzle edges of the parts are arranged to fit against each other.

LIST OF FIGURES

Figure 2:
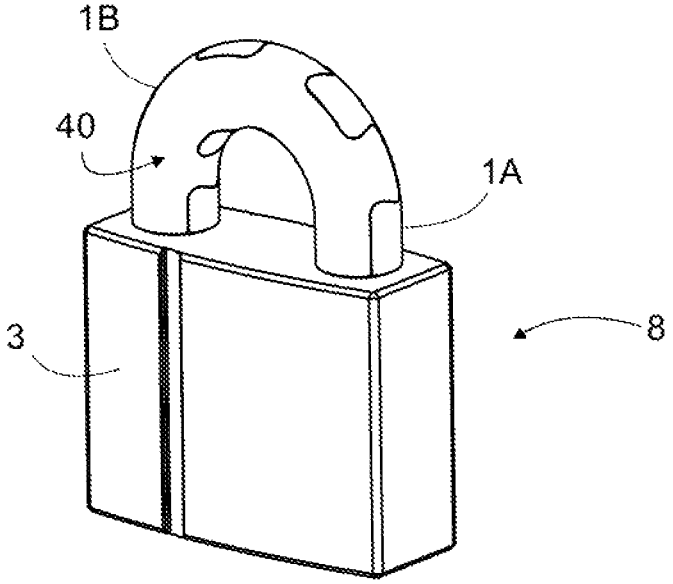
Figure 3:
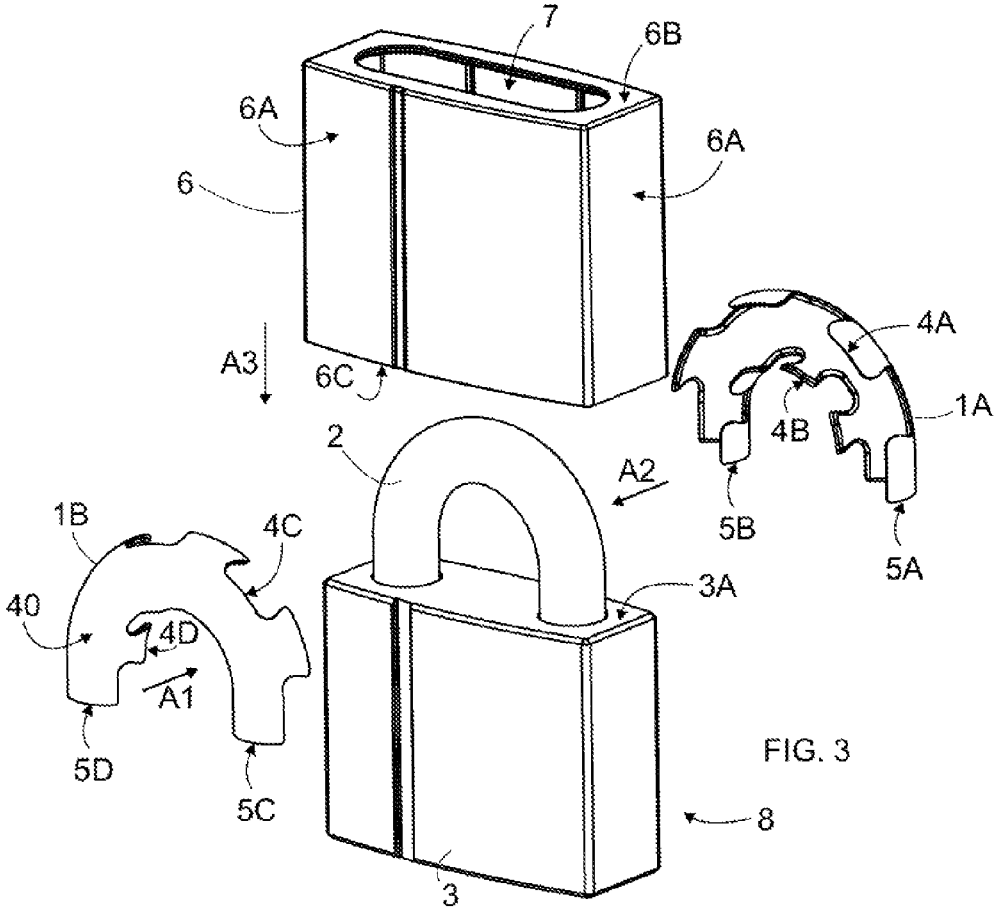
Figure 4:
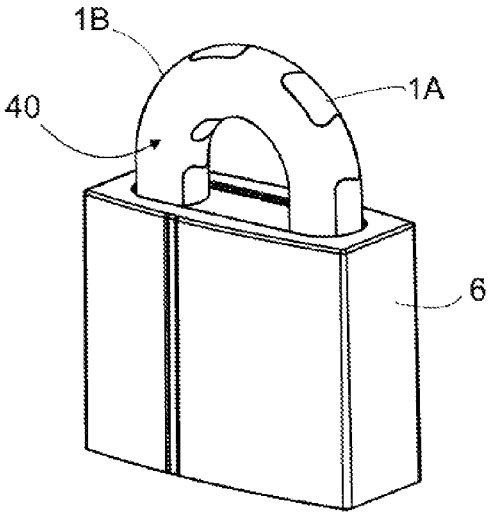

In the following, the invention is described in more detail by means of the accompanying figures, in which FIG. 1 shows an example of a padlock protector according to the invention, FIG. 2 shows the example of FIG. 1 as installed on the padlock, FIG. 3 shows another example of a padlock protector according to the invention, and FIG. 4 shows the example of FIG. 3 as installed on the padlock.

DESCRIPTION OF THE INVENTION

FIG. 1 shows an example of a padlock protector according to the invention. The padlock protector comprises a shackle protector composed from two parts 1A, 1B. The parts are to be placed to the opposite sides of the shackle 2. The parts are formed into the shape of the loop and surface of the shackle 2A. The shackle is a U-shaped loop in shape, which together with the body 3 of the padlock 8 forms a closed loop. As can be seen from the figure, the side edges 4A, 4B, 4C, 4D of the parts are jigsaw puzzle edges in their shape.

The jigsaw puzzle edges of the parts 1A, 1B fit against each other. Additionally, the parts are manufactured from a suitably flexible material, such as from a plastic suitable for the purpose. When the parts are placed from the opposite sides of the shackle 2 against each other, the jigsaw puzzle edges 4A, 4B, 4C, 4D flex such that the parts settle against the surface 2A of the shackle and the edges go against each other. The outer surfaces 40 of the parts are therefore curved, and they curve according to the surface 2A of the shackle. The parts cover the surface of the shackle of the padlock 8 in the locking position, wherein the shackle 2 is not free to come into direct contact with its corresponding part(s) to be locked. Arrows A1 and A2 show, how the parts of the shackle protector are placed onto the shackle. FIG. 2 shows, how the parts 1A, 1B of the shackle protector cover the shackle. The jigsaw puzzle edges 4A, 4B, 4C, 4D fit against each other, wherein the parts 1A, 1B on the opposite sides of the shackle 2 are connected to each other via the jigsaw puzzle edges.

The doors of many storages and properties are provided with metal loops or metal plates having holes for the shackle of a padlock, so that they can be locked with a padlock. The metal plates and metal loops are often made from stainless steel, wherein the shackle of the padlock begins to rust due to electrochemical corrosion. The shackle of the padlock is generally of hardened steel, which can also be chrome-plated. If the chrome is worn or has been broken, then the shackle is readily susceptible to corrosion.

FIG. 3 shows an example of a padlock protector according to the invention, comprising, in addition to the shackle protector 1A, 1B described above, a protective case 6 having solid sides 6A and an open base 6C. The case has a top side 6B with a hole 7. The case is easy to place onto the padlock 8 by threading it from the side of the shackle 2 onto the lock body 3. The arrow A3 shows the placing of the case onto the body of the padlock. The hole 7 of the top side 6B is fitted such that the shackle fits through the hole. The solid area of the top side 6B settles against the upper surface 3A of the body of the padlock. The protective case 6 protects the surface of the body of the padlock from wear and also largely prevents direct contact of external parts with the body 3. FIG. 4 shows, how the padlock is protected with a case 6 and a shackle protector 1A, 1B.

Both the shackle protector 1A, 1B and the protective case 6 are manufactured from a plastic suitable for the purpose, one which flexes suitably. Thus, the shackle protector and protective case flex somewhat, and the jigsaw puzzle edges 4A, 4B, 4C, 4D of the shackle protector can be placed against the surface 2A of the shackle. A suitable plastic also insulates the shackle from above said metal plates or metal loops, preventing corrosion conditions from forming. A shackle protector also protects the surface of the shackle from wear. Because the shackle 2 itself withstands water quite well, thus it does not need to be waterproof. A shackle protector is fast and easy to install around a shackle. It can also be refitted to existing padlocks. A shackle protector can be symmetrical, i.e. the parts 1A, 1B are similar, as is shown in the figures. In this case, the same component fits both sides of the shackle. The parts can also be manufactured as different, i.e. asymmetrical. In asymmetrical parts, the jigsaw puzzle edges also settle against each other.

As can be observed from the figures, the end edges 5A, 5B, 5C, 5D of the parts are even in the present embodiment. Depending on the shape of the padlock, the end edges can also be formed to follow the shape of the body of the padlock. The end edges 5A, 5B, 5C, 5D can therefore be, for example, curved. The jigsaw puzzle edges 4A, 4B, 4C, 4D can be formed in a different manner, nor do they therefore necessarily need to be in the shape shown in the figures. Both parts of the shackle protector are formed into a U-shape. Because the shackle 2 (the loop of the shackle) can be formed in many various manners, by U-shape is meant, in this connection, any shape of the bent shackle, which forms with the padlock a closed loop. The most common cross-section of the loop of the shackle is a circle, as it is advantageous in relation to manufacture and use. However, it is possible that the cross-section has some other shape, wherein the shape of the surface of the loop deviates from being a circular surface, and the shackle protector is formed into the corresponding shape of the surface. The outer surfaces of the parts of the shackle protector are therefore curved. The parts curve onto the shackle.

In light of the examples presented above, it is obvious that an embodiment according to the invention can be provided by many various solutions, not merely by the examples presented in this connection. The invention can therefore be implemented by various embodiments within the scope of the presented claims.

The invention claimed is:

1. A padlock protector comprising:

a shackle protector, the shackle protector comprising two parts, which are configured to be placed on opposite sides of a shackle, each of the two parts having a side edge having a shape of jigsaw puzzle edges, wherein each of the two parts has a first concave surface and a second convex surface opposite to the first surface, and wherein the two parts are configured to cover only a portion of the shackle disposed outside the padlock body.

2. The padlock protector according to claim 1, wherein end edges of the two parts are flat.

3. The padlock protector according to claim 2, wherein outer surfaces of the two parts are curved.

4. The padlock protector according to claim 3, wherein the parts are of a flexible material.

5. The padlock protector according to claim 4, further comprising a protective case, the protective case comprising:

solid sides;

an open bottom; and a top side with a hole.

6. The padlock protector according to claim 5, wherein the hole of the top side is fitted and configured to receive the shackle through the hole.

7. The padlock protector according to claim 1, wherein the two parts of the shackle protector, when fit together, form a U-shaped body.

8. The padlock protector according to claim 1, wherein the two parts of the shackle protector, when fit together, have a same shape as the shackle on which they are placed.

9. The padlock protector according to claim 1, wherein the two parts form a longitudinal shape of a loop.

10. The padlock protector according to claim 9, wherein the jigsaw puzzle edges are disposed along the loop and curve toward an arched axis of the two parts.

11. The padlock protector according to claim 1, wherein the jigsaw puzzle edges of a first part of the two parts lock against the jigsaw puzzle edges of a second of the two parts.

12. The padlock protector according to claim 1, wherein, when fixed together, the two parts form a round external surface and a round internal surface.

13. The padlock protector according to claim 1, wherein, when fixed together, the two parts form an internal curved tunnel configured to receive the shackle.

14. The padlock protector according to claim 1, wherein the two parts each has a curved outer surface and a curved inner surface.

15. A padlock, comprising:

a padlock body;

a shackle attached to the padlock body; and a padlock protector comprising:

a shackle protector, the shackle protector comprising two parts, which are configured to be placed on opposite sides of the shackle, each of the two parts having a side edge having a shape of jigsaw puzzle edges, wherein each of the two parts has a first concave surface and a second convex surface opposite to the first surface, and wherein the two parts are configured to cover only a portion of the shackle disposed outside the padlock body.

* * * * *